US005562810A

United States Patent [19]

Urquhart

[11] Patent Number: 5,562,810

[45] Date of Patent: Oct. 8, 1996

[54] AUTOMATED ELECTRODEPOSITION LINE

[75] Inventor: Gordon T. Urquhart, Birmingham, Mich.

[73] Assignee: Volcor Finishing, Inc., Bloomfield Hills, Mich.

[21] Appl. No.: 375,944

[22] Filed: Jan. 20, 1995

[51] Int. Cl.[6] ..... C25D 17/20

[52] U.S. Cl. ..... 204/213

[58] Field of Search ..... 204/213, 214

[56] References Cited

U.S. PATENT DOCUMENTS

| | | | |
|---|---|---|---|
| 3,582,526 | 6/1971 | Campana | 204/213 |
| 3,803,007 | 4/1974 | Jessup | 204/213 X |
| 3,862,896 | 1/1975 | Singleton | 204/213 X |
| 4,062,752 | 12/1977 | Peterson | 204/213 |
| 4,399,828 | 8/1983 | Kontos | 204/213 X |
| 4,469,526 | 9/1984 | Budinsky et al. | 204/213 X |
| 4,521,288 | 6/1985 | McInnes | 204/213 |
| 4,673,444 | 6/1987 | Saito et al. | 148/6.15 Z |
| 5,104,507 | 4/1992 | Offenburger | 204/180 |
| 5,202,383 | 4/1993 | Moriarity et al. | 525/124 |
| 5,236,565 | 8/1993 | Muller et al. | 204/181.3 |
| 5,385,655 | 1/1995 | Brent et al. | 204/181.1 |

*Primary Examiner*—Donald R. Valentine
*Attorney, Agent, or Firm*—Dykema Gossett PLLC

[57] ABSTRACT

An automated cathodic electrodeposition line has a barrel carriage assembly that is electrically energized only when in contact with a treatment tank or an overhead programmed hoist. A parts transfer shuttle moves phosphated parts from one treatment barrel to another barrel and between separate sections of the coating line to reduce cross contamination. An automatic parts loader rotates a bin filled with parts into a parts discharge position for loading parts onto a vibrating tray that in turn moves parts into a treatment barrel. Cathodically coated parts are cured by infra-red parts in a curing oven.

17 Claims, 5 Drawing Sheets

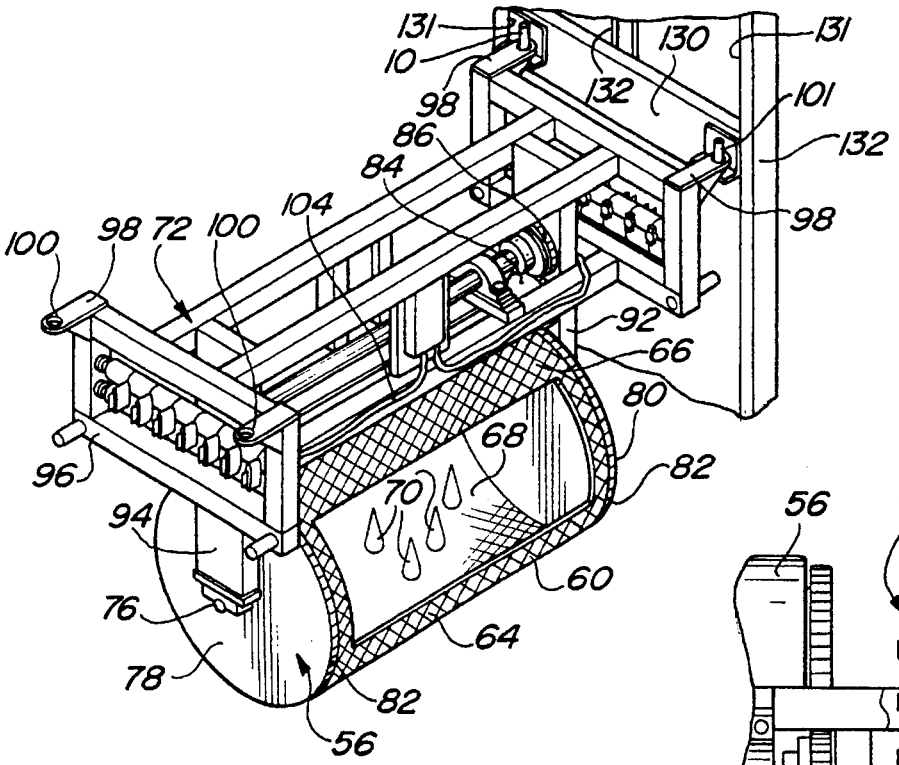
Fig - 6
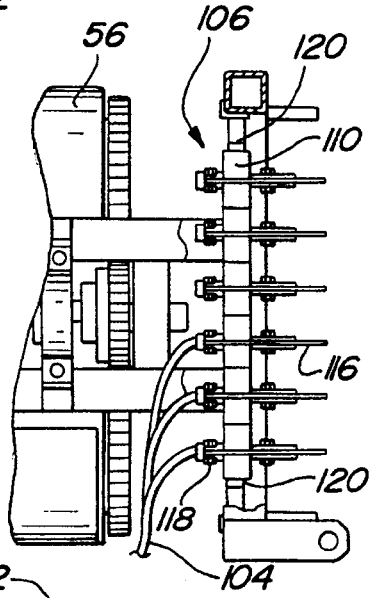
Fig - 7
Fig - 8
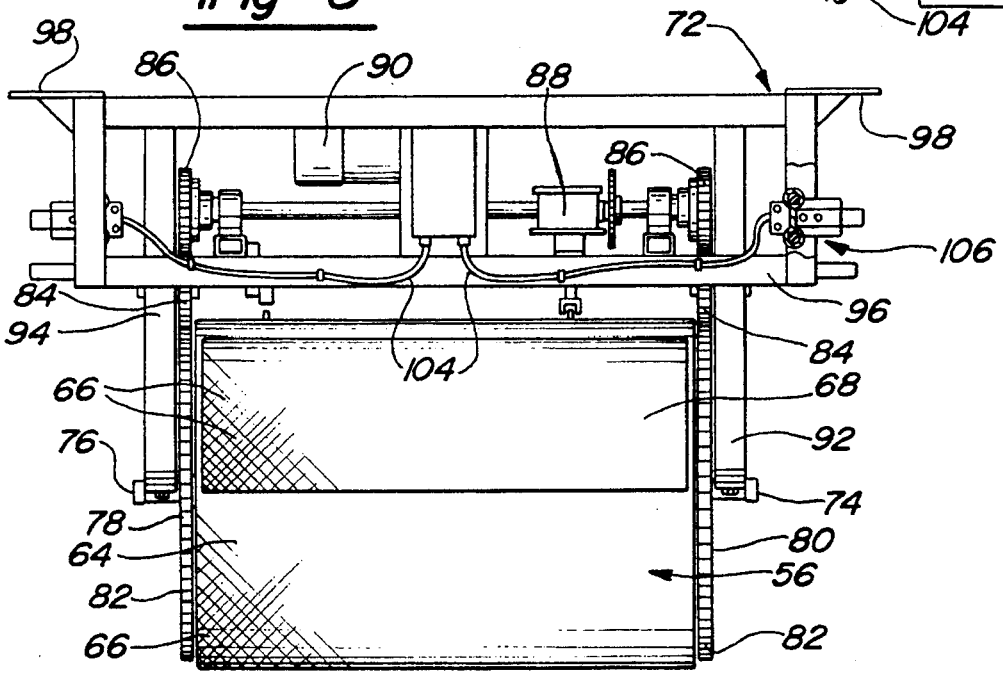

AUTOMATED ELECTRODEPOSITION LINE

FIELD OF THE INVENTION

The present invention relates generally to equipment for use in electrodeposition processes in which protective coatings are formed on the surfaces of a metal parts. More specifically, the present invention relates to equipment for use in an automated processes for the bulk metal finishing of relatively small metal parts and to an automated electrodeposition line.

BACKGROUND OF THE INVENTION

A number of techniques exist for forming a corrosion resistant coating on metal parts. One such process is disclosed in my co-pending application filed on even date herewith entitled "Cathodic Electrodeposition Process," the entire disclosure of which is incorporated herein by reference. Therein, a process is disclosed in which a plurality of electrically conductive, small metal parts are placed in a pretreatment barrel. The parts are pretreated by sequentially immersing the barrel in a first series of tanks containing phosphating and rinse solutions. A phosphate coating is formed on the surface of the parts in the barrel to provide increased corrosion resistance. The phosphated parts are then transferred from the pretreatment barrel to a cathodic E-coat barrel in which the parts are coated with a heat-curable organic film by electrodeposition. The coated parts are transferred from the electrodeposition barrel to a conveyor. The conveyor moves the coated parts through a curing oven where the organic coating is cured by infra-red lamps. It has been found that this method is extremely efficient for electro-coating small metal parts which are difficult to process using prior art techniques. The coatings produced using this method are durable and have a minimum number of touch points or gaps in the coating. The method is particularly suited for coating parts with threaded portions and similar fine structures.

As will be appreciated by those skilled in the art, a number of problems are inherent in the equipment used in many prior art electrodeposition lines which make such lines difficult to automate and which interfere the ability to obtain a uniform surface coating on all parts in a bulk treatment operation. In those applications in which it is important to avoid gaps in the surface coating, prior art techniques may require that the parts undergo multiple paint cycles and the like. For example in U.S. Pat. No. 5,104,507, "Anodic-Cathodic Coating for Fasteners" it is disclosed that it is necessary to apply at least two separate electrodeposition operations with an interim curing stage in order to obtain complete coverage. In U.S. Pat. No. 4,165,242, "Treatment of Metal Parts to provide Rust-Inhibiting coatings by Phosphating and Electrophoretically depositing a Siccative Organic Coating," it is disclosed that improved corrosion resistance of small metal parts can be obtained through the application of a final surface layer of a petroleum oil as a top coat. Therein, the parts are first phosphated and electrocoated prior to application of the oil top coat.

Accordingly, it is an object of the present invention to provide automated equipment for the bulk treatment of metal parts in which the surface of the parts is modified in successive stages to provide a superior corrosion resistant coating.

It is also an object to provide a carriage for a treatment barrel that allows vertical movement of the carriage and rotational movement of the barrel without the permanent attachment of an electrical cable to the carriage.

It is also an object of the present invention to provide an apparatus for transferring small metal parts from a first treatment barrel to a second treatment barrel in an electrodeposition line.

It is still a further object of the present invention to provide an overall automated electrodeposition line which utilizes barrel immersion technology to form coatings on small metal parts without the disadvantages of prior art batch processing systems.

It is still a further object of the present invention to provide a substantially fully automated phosphating and electrodeposition coating line in which a phosphate coating and a cathodically applied organic top coat are applied sequentially without cross contamination of the processing equipment.

SUMMARY OF INVENTION

In one aspect the present invention provides a substantially fully automated coating line which comprises a bin rotator that unloads small metal parts onto a vibratory feeder. The parts move along a retractable vibrating tray to the edge of the tray which extends through an opening in a first treatment barrel. The parts then drop from the tray into the treatment barrel. The barrel has meshwork walls which serve to contain the small metal parts but which allow treatment solutions to enter and exit the barrel rapidly as it moves in and out of treatment tanks. The barrel is mounted on a support structure or carriage which permits the barrel to be rotated in a series of predetermined positions for alignment of the barrel opening with feeders and the like and which also allows the barrel to be oscillated to agitate the parts. The interior of the barrel is fitted with a plurality of cones or dividers which help reduce gaps on the coated parts by providing for greater separation of the parts during treatment. An overhead crane or programmed hoist intermittently engages the barrel carriage to move the barrel between treatment stations. The crane moves the carriage vertically such that the barrel can be lowered into a treatment tank and then lifted from the tank after treatment. In addition, the overhead crane moves along horizontal tracks such that the barrel can be moved horizontally to each station.

In another aspect, the present invention provides a novel arrangement of electrical connectors for use in an a barrel immersion coating system. The barrel is mounted on an bearing which allows rotatory movement. A motor is mounted on the carriage to rotate the barrel through a series of positions that are controlled by a microprocessor. The carriage has a plurality of electrical contacts mounted on a side bracket which are connected by an electrically conductive cable to the carriage motor. As the carriage is lifted by the crane it moves into a horizontal transfer position where it contacts a set of mating electrical wiper connectors on the crane. As the crane lowers the barrel carriage to the tank position, the carriage contacts engage the mating wiper contacts mounted on the end of the tank support structure. In this manner the carriage does not require a permanently attached electrical cable, allowing the crane to move to a treatment tank, deposit the barrel and carriage and barrel at the tank and then move (without the barrel and carriage) to another station to raise a second barrel.

In still another aspect the present invention provides an automated parts transfer apparatus by which metal parts are transferred from a first treatment barrel to a second treatment barrel. The transfer apparatus includes a gravity feed loader into which pretreated parts are discharged from a first barrel.

The pretreated parts move downwardly through a chute into a second treatment barrel which is moved into position by a lateral transfer shuttle. The barrel transfer mechanism eliminates cross-contamination present in a number of prior art systems.

BRIEF DESCRIPTION OF THE DRAWINGS

FIG. 6 is a perspective view of the barrel and barrel carriage of the present invention, illustrating the side-mounted electrical connectors.

FIG. 7 is a top fragmentary view of the carriage and barrel assembly of FIG. 6, illustrating the blade electrical connectors.

FIG. 8 is a front view of the carriage and barrel assembly of FIGS. 6 and 7.

DETAILED DESCRIPTION OF THE PREFERRED EMBODIMENTS OF THE INVENTION

Figure 1:
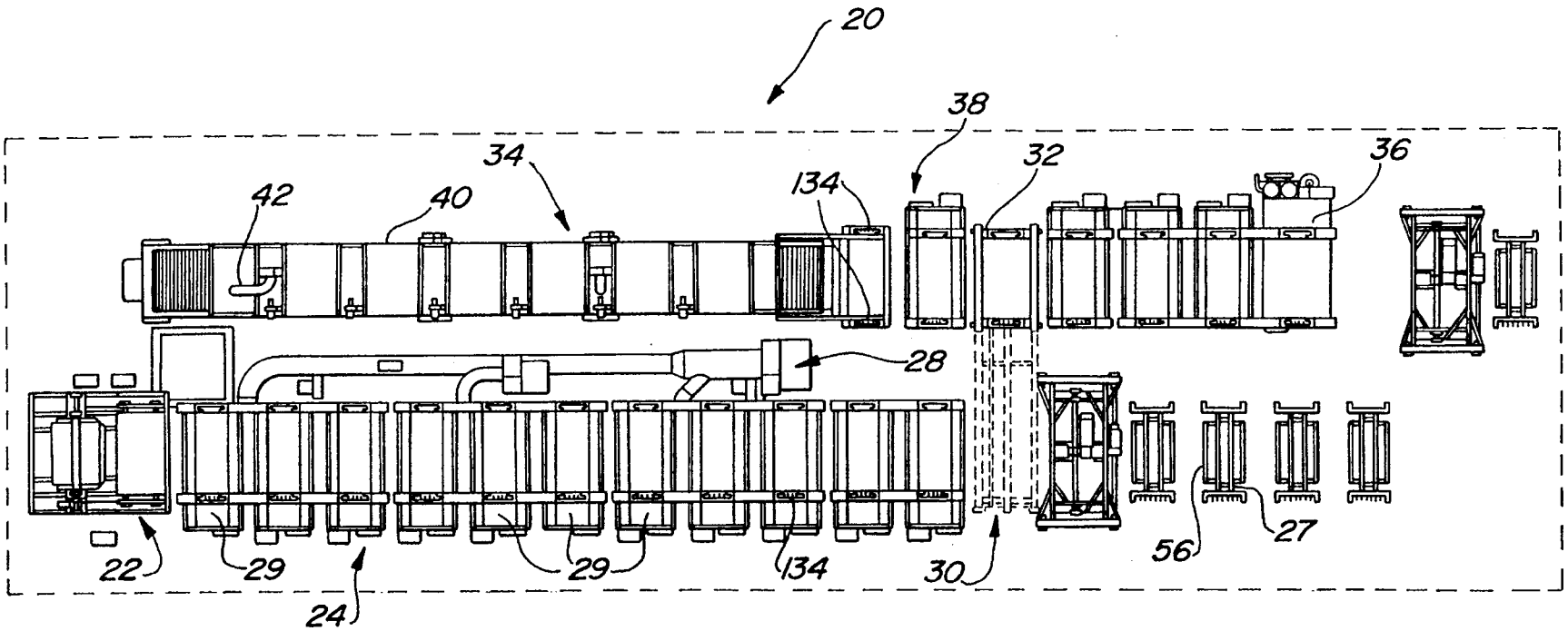
FIG. 1 is a plan view of the automated coating line of the present invention in one preferred embodiment.
Figure 2:
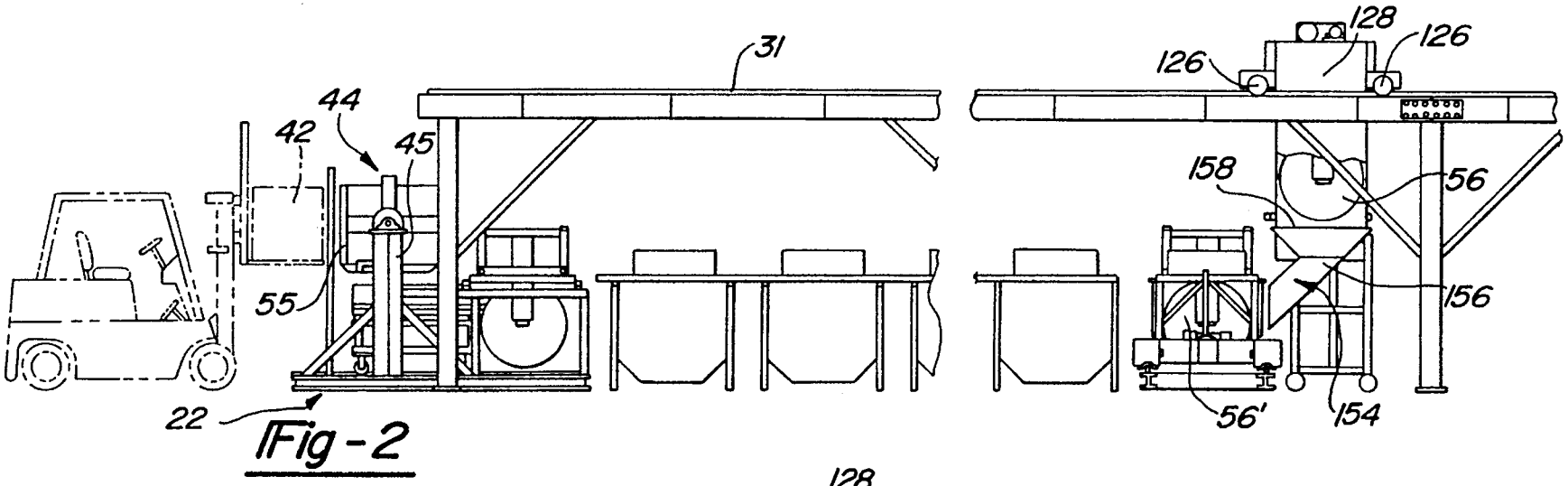
FIG. 2 is a plan view of a portion of the automated coating line of FIG. 1, illustrating the barrel loading station and pretreated parts transfer station.
Figure 3:
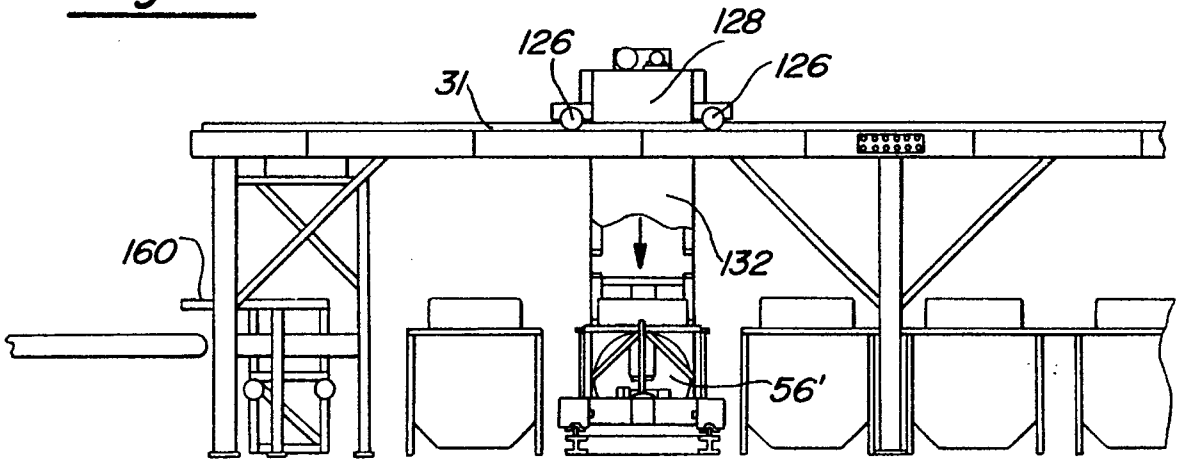
FIG. 3 is a plan view of a portion of the automated coating line of FIG. 1, illustrating vertical movement of the treatment barrel and the curing of conveyor belt.
Figure 4:
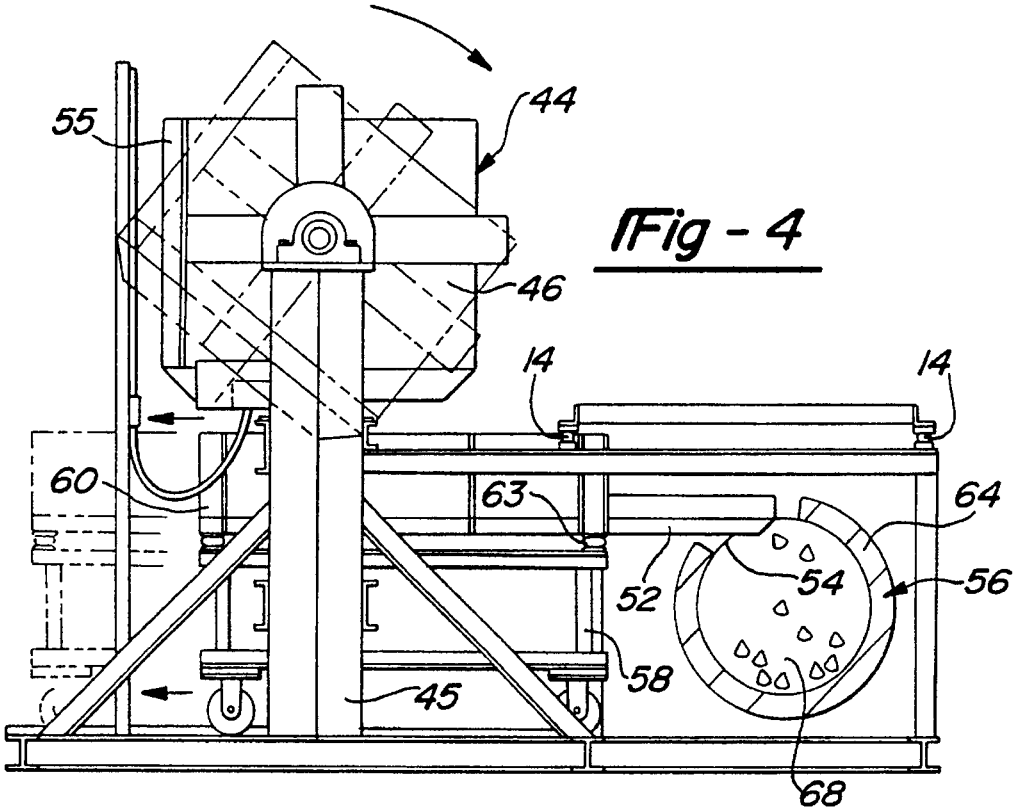
FIG. 4 is a plan view of the rotational parts loading mechanism, including the vibratory transfer tray.
Figure 11:
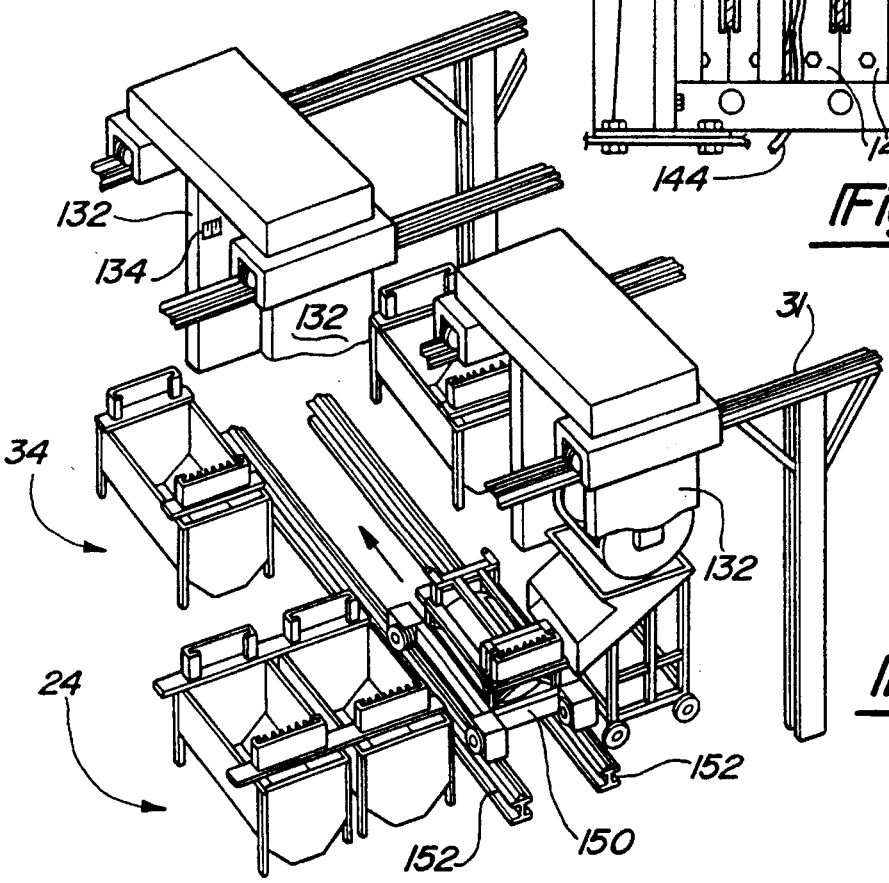
FIG. 11 a perspective view of a portion of the automated coating line shown in FIG. 1, illustrating the parts transfer apparatus.

Referring now to the FIG. 1 of the drawings, automated coating line 20 is shown generally an has an overhead programmed hoist or crane 21 which moves barrels 26 mounted on carriages 27 between treatment stations and into and out of treatment tanks 29. The overhead support track for crane 21 is not shown in FIG. 1 for simplicity but is shown in FIGS. 2, 3 and 11 as track 31. As will be appreciated by those skilled in the art of coating line design, line 20 has a number of stations through which parts are conveyed to receive specific surface treatments. Bin unloading station 22 is seen at the beginning of phosphate line 24 and serves as the site for loading the untreated metal parts into barrel 26 as shown in FIG. 4 of the drawings.

The present invention is specifically designed as a barrel immersion line although certain aspects of the invention could be adapted to other uses. Phosphating line 24 comprises a series of tanks 29 which are spaced apart a predetermined distance in the conventional manner along a straight line. Tanks 29 are designed to hold the various solutions necessary for metal treatment. Accordingly, the initial tanks in phosphating line 24 contain the solutions necessary for cleaning the surfaces of the parts such as detergents and rinses and the subsequent tanks contain the phosphating solutions such as zinc phosphate solutions. In order to properly ventilate the work area exhaust system 28 is provided in association with tanks 26 of phosphate line 24. A number of exhaust systems which are suitable for this purpose will be known by those skilled in the art.

Automated coating line 20 further includes parts transfer station 30 which has a transfer shuttle 32 that moves a treatment bartell from phosphate line 24 to electrodeposition/curing line 34. Electrodeposition tank 36 is provided which contains a cathodic organic coating for use in forming an E-coat on phosphated parts as will be more fully described hereinafter. Unloading station 38 for the coated parts is shown at the beginning of curing oven 40. The coated parts move though oven 40 on a conveyor belt. An exhaust system 42 is also shown in association with curing oven 40.

It is to be understood that although a separate phosphating line 26 and electrodeposition/curing line 34 are shown, the two lines are actually components of the overall coating line 22 and are separated in this preferred embodiment to provide better space utilization. Thus, coating line 20 comprises a split line with a lateral parts transfer mechanism which in this embodiment comprises parts transfer mechanism 30.

Although the apparatus of the present invention may be suitable for use in coating a wide variety of metal parts, it is particularly suited for the treatment of small metal parts. That is, parts which are unsuitable for conventional rack coating processes wherein the parts are individually moved through coating stations supported by individual hangers or the like. Most preferably, small metal parts treated in accordance with the present invention will comprise fasteners such as screws, bolts and the like having difficult treatment areas such as threaded portions, and other small metal parts such as clamps and the like. In general small metal parts suitable for treatment in the present invention will be those parts which can more economically be treated in bulk as provided herein and may include somewhat larger parts so long as the apparatus used in the present invention can accommodate multiple parts in a single treatment barrel. Most preferably, the small metal parts coated in the present invention will each weigh less than about one pound and each has a surface area of less than one square foot. The metal parts may be plated, for example with zinc or an alloy of zinc and nickel or non-plated ferrous metal substrate. It is to be understood that the present invention may be useful in plating any number of metals and it is not intended that the scope of the application be limited by any of the specific materials described in this detailed description.

Figure 5:
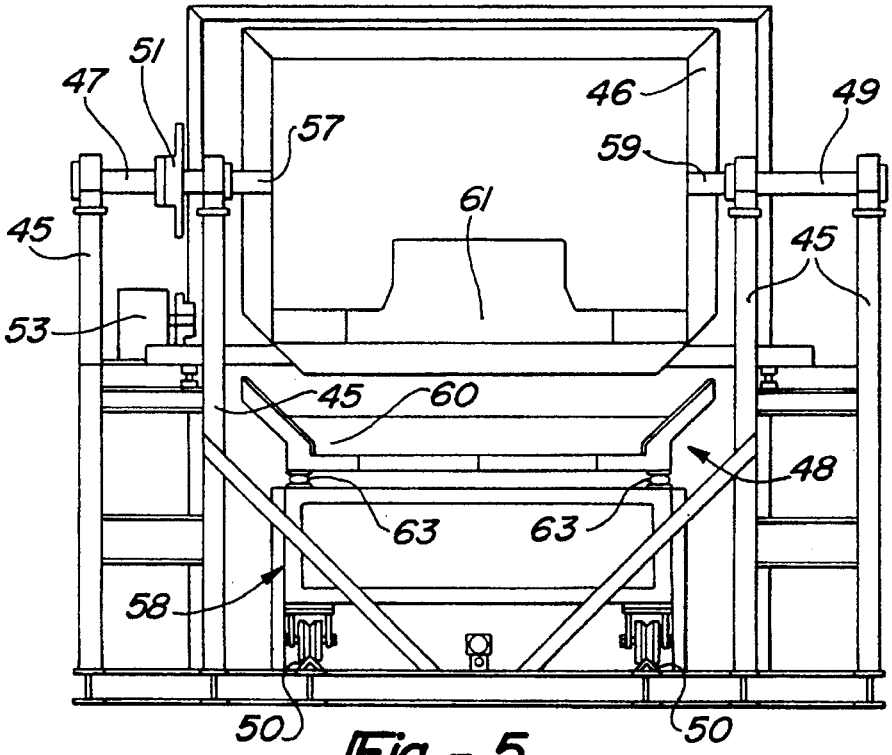
FIG. 5 is an end view of the parts loading apparatus of FIG. 4.

Referring now to FIG. 2 of the drawings, a bin 42 of small metal parts is loaded into bin rotator 44 is at bin unloading station 22 as best shown in FIGS. 4 and 5. Bin rotator 44 has upright frame members 45 which support journaled shafts 47 and 49. Ends 57 and 59 of shafts 47 and 49 are attached to bin container 46. Shaft 47 includes gear 51 which is driven by motor 53 by a drive chain (not shown). Bin 42 (FIG. 2) slides into opening 55 of bin rotator 44 and bin rotator 44 pivots as shown in phantom in FIG. 4 to discharge parts through opening 61 which may include a hinged door which moves open only as bin rotator 44 is tilted to discharged parts. Vibratory tray assembly 48 rides on tracks 50 between first and second positions, the second position being a barrel loading position in which tray discharge extension 52 extends into opening 54 of barrel 56 as seen in FIG. 4. Vibratory tray assembly 48 includes chassis 58 on which tray 60 is supported by rubber air cushions 63 which permit tray 60 to vibrate. Load cells 14 may be provided to determine a full-load condition. In operation tray 60 moves forward to the barrel loading position at which point tray extension 52 extends into opening 54 of barrel 56. Opening 54 is properly positioned by the action of carriage 72 in a manner which will be more fully explained hereinafter. Bin rotator 44 rotates the full bin 42 of parts and a preset number of parts fall onto the surface of tray 60. It is to be understood that line 20 is substantially fully automated and that the controls and microprocessor for computer control of the system can be located at any convenient position along the line. Tray 60 is then vibrated, and the small, electrically conductive metal parts 62 to be treated in accordance with the present invention drop into barrel 56. When the maximum load of parts is detected a signal is sent to the central controller, which is preferably a microprocessor, and bin rotator returns to level position. Barrel 56 as mounted on carriage 72 is then picked up by crane 21 and delivered to the first tank 29 in phosphate line 24.

Barrel 56 is shown in FIGS. 6 and 7 as comprising a metal or plastic meshwork body 64 which has holes or perforations 66 that allow fluids to move in and out of barrel treatment chamber 68. The size of the individual holes must be large enough to allow the rapid flow of treatment solutions into barrel 56 as it is lowered into the various tanks and to allow for substantially all of the treatment solution to flow rapidly out of barrel 56 when barrel 56 is raised from the tank. In addition, holes 66 must be small enough to retain the small metal parts to be treated with chamber 68. For many applications, holes of from about ⅛ inch to about ⅜ inch in diameter will be sufficient. In addition, it is most preferred that the interior of barrel 56 include a number of spacers 70 which are shown here as cone shaped structures. Spacers 70 serve to reduce touch points in the coated parts and improve parts agitation. They may be formed of metal or plastic and extend outwardly from the interior surface of barrel 56 about 4 to 8 inches. Preferably when in the shape of cones, spacers 70 have a base diameter of from about 2 inches to about 4 inches and are fastened to the interior of barrel 56 using conventional fastening means.

As shown best in FIGS. 6 and 8, barrel 56 is mounted on powerless carriage or frame 72 on bearing members 74 and 76 that are connected to end walls 78 and 80 of barrel 56. End walls 78 and 80 have outer rims 82 which are in the nature of sprockets which are driven by gears 84, gears 86, and motor 90. Rotary limit switch 88 is provided to indicate the rotational movement of barrel 56 to predetermined positions. Barrel support masts 92 and 94 extend downwardly from frame 96 and are attached to bearings 74 and 76. Barrel 56 can thus rotate by the action of motor 90 and the associated gears around the pivot point of bearings 74 and 76 as will be more fully described. Frame 96 includes lift arms 98 having holes 100 that are engaged by lift posts 101as shown in FIG. 6 of the drawings on the overhead programmed hoist 21. Guide posts 102 are also provided which slide between guide pins (not shown) on the individual tanks.

Electrical energy is transmitted to motor 90 through cables 104 from vertical male electrical assembly 106, one of which is shown in detail in FIG. 7. Vertical male electrical assembly 106 is mounted on one or more horizontal support shaft 108. A series of insulator cuffs 110 having bores therethrough to receive support shaft 108, and preferably two overlying bores to accommodate two such shafts, are fitted over shaft 108 as best seen in FIG. 6 and 7. Adjacent insulative cuffs form cavities 112 to hold blade contacts 116. Each metal blade contact 116 has portion 118 to which one end of each electric cable 104 is attached. Blade contacts 116 may each be individually connected in this manner or may by connected in series (not show). A number of methods may be utilized to hold cuffs 110 and blade contacts 116 in place such as fasteners 120 at the ends of the cuff arrays as shown in FIG. 7.

Vertical male electrical assembly 106 is provided to permit movement of carriage 72 between vertical positions without requiring a permanent attachment to a power source, but still allowing barrel 56 to be rotated by motor 90 when in position in a tank or when fully raised by crane 21. More specifically, and referring now to FIG. 2 the drawings, programmed hoist 21 is shown generally having overhead track 31 on which wheels 126 of hoist carriage 128 ride. Hoist carriage 128 moves along track 124 to various stations, either above a tank or at a loading, unloading, or parts transfer station. As shown in FIG. 6, side lift member 130 moves vertically in channels 131 on side panels 132 of hoist carriage 128. That is, there is a separate side lift member 130 in each opposed side panel 132 of hoist carriage 128. Side lift members 130 are actuated by a chain mechanism 132, i.e. they are raised and lowered in this manner. In operation, programmed hoist 21 moves into a position, for example above a barrel immersed in a tank, with lift member 130 in the lowermost position. This allows lift member 132 to slide beneath tabs 98 of carriage 72 such that posts 101 are positioned directly below holes 100. Lift member or bar 130 is then raised by chain mechanism 132 such that posts 101 move into holes 100, thereby causing lift member 130 to engage carriage 72 and move it upwardly. In this manner the barrel is lifted from the tank, is carried to another station by crane 21 and is then lowered in the same manner; crane 21 may disengage the barrel and move to another station for another operation. As carriage 72 is in transit vertically, i.e. either being raised or lowered by lift member 130, it is not connected to a source of electrical power. In other words electrical connector 106 is a free electrical connector which is energized only if it engages a "hot" electrical mating contact or a contact which can be subsequently energized. It will be appreciated that this construction provides a high-voltage connection, preferably from about 200 to 400 volts.

Figure 9:
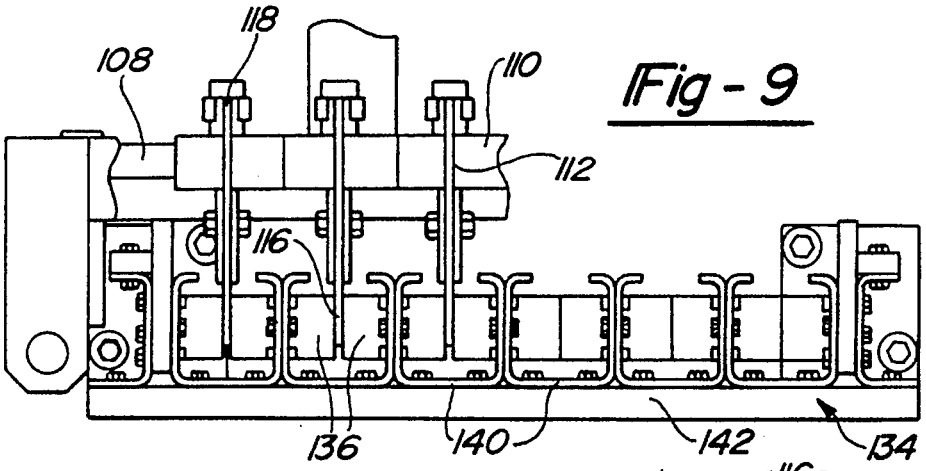
FIG. 9 is a fragmentary top view of the engagement of the barrel carriage electrical connectors and the corresponding tank-mounted electrical connectors.
Figure 10:
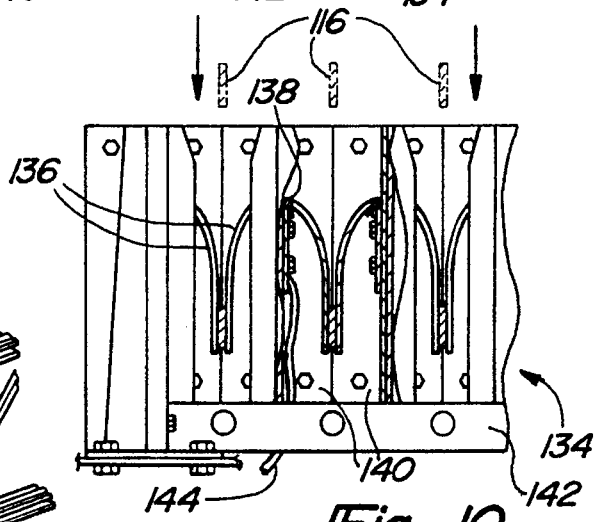
FIG. 10 is a fragmentary side elevational view of the blades of the carriage and barrel assembly connectors moving toward engagement of the tank-mounted electrical connectors.

In order for carriage 72 to be electrically connected such that motor 90 can function to rotate barrel 56, vertical male electrical connector 106 must engage female electrical wiper contact 134 as best shown FIG. 9. A female electrical wiper contact 134 is mounted on each tank 29 (and electrodeposition tank 36) where it is necessary to rotate barrel 56 for agitation. In some instances a female electrical wiper contact 134 is mounted at each end of tank 129 to allow additional control of rotational barrel movement. As carriage 72 moves downwardly, immersing barrel 56 in the tank, contact blades 112 of contact 106 slide between wiper contact plates 136 of vertical female electrical wiper connector 134 as best shown in FIG. 10. Another vertical female electrical wiper connector 134 (FIG. 11) is mounted at the top of side panel 132 of programmed hoist or crane 21. As carriage 72 is lifted by lift member 130 to the uppermost position, vertical male electrical wiper connector 106 engages the programmed hoist mounted vertical female electrical wiper connector 134, thereby establishing the link for electrical power to motor 90 such that barrel 56 can be rotated for dumping parts or the like in the fully raised position. By oscillating barrel 56 in the upward position, chemical drag from tank to tank may also be reduced.

Vertical female electrical wiper connector 134, and referring now to FIGS. 9 and 10 of the drawings, has a series of mating electrical contacts or wipers 136 which are paired to form a channel which is forced open by the action of blades 116. In other words wiper contacts 136 comprise bent metal strips which are mounted with spring hinges 138 and have sufficient spring to bias against blades 116 as blades 116 are inserted therebetween to establish and maintain good electrical contact. Wiper contacts 136 are mounted on a series of brackets 140 which in turn are fastened to vertical female electrical mounting structure 142. A number of power connections may be suitable for connecting vertical female electrical wiper connector 134 to a power source with one such cable arrangement being shown in FIG. 10 as cable 144.

Accordingly crane 21 lowers carriage 72 such that blades 116 engage wiper contacts 136 whereupon barrel 56 in tank 29 can be agitated in a pretreatment wash solution or the like. It will be appreciated by those skilled in the art that a number of phosphating and rinse operations can be used in the present invention in order to form the desired phosphate coating on the surfaces of the metal parts. Most preferred is an aqueous zinc phosphate treatment coupled with several rinses. Suitable phosphating techniques for use in the present invention are described generally in the art, such as in U.S. Pat. No. 3,860,455, "Method for Phosphatizing Ferrous Surfaces" and U.S. Pat. No. 3,338,755, "Production of Phosphate Coatings on Metal Parts," the entire disclosures of which are incorporated by reference. Pursuant to those teachings any surface residue such as grease and the like is removed in pretreatment wash and rinse operations if necessary. In general, aqueous acid solutions incorporating metal phosphates dissolved therein of the so-called coating type including zinc phosphate, manganese phosphate, and iron phosphate which precipitate on the surface of the metal being treated forming the phosphate coating thereon are preferred for use herein. Zinc phosphate constitutes the principal coating-type phosphate compound employed for forming such phosphate coatings.

After an appropriate phosphate coating has been formed on the metal parts, the parts are moved from phosphate line 24 to electrodeposition line 34. It was discovered that solution carryover from the pretreatment stages (i.e. tanks 29 of phosphating line 24, was significant and resulted in contamination of electrodeposition tank 36 in electrodeposition line 34). Accordingly, an automated parts transfer mechanism was devised which includes shuttle 32 that allows the phosphated parts to be transferred to a clean barrel for subsequent electrodeposition treatment.

Referring now to FIGS. 3 and 11 of the drawings, shuttle cart 150 is shown which rides on shuttle tracks 152 between phosphate line 24 and electrodeposition/curing line 34. Carriage 72 is seen positioned on shuttle cart 150 in transit between line 24 and line 34. Referring to FIG. 2 of the drawings, crane 21 lifts barrel 56 from the last phosphate line tank 29 and moves tank 29 to a position above hopper/feeder 154. Hopper/feeder 154 includes a hopper/chute 156 into which parts are loaded during a barrel transfer procedure. Hopper/chute 156 has an opening 158 into which parts fall from barrel 56 as it is rotated so that opening 54 is in register with opening 158. As parts fall into hopper/chute 156 they slide down the chute portion of hopper/chute 156 and fall into a clean barrel or electrodeposition barrel 56' which has been placed in position by crane 21 in a previous operation. After all of the parts have been transferred in this manner from barrel 56 to barrel 56', barrel 56' and its associated carriage 72' move on shuttle cart 150 to electrodeposition line 34 where they are picked up by crane 21 and moved through the cathodic electrodeposition stations and to the curing oven. It will be appreciated that a single crane 21 could be used in the present invention if lines 24 and 34 are combined into a single line rather than a split line as illustrated, but it is preferred that the system be provided with two such cranes for better control of processing time.

At the first E-coat station, the E-coat barrel is lowered into tank 36 containing an organic coating solution suitable for cathodic electrodeposition. The preferred coating solution is a water dispersible paint in which the organic coating material which forms a film on the surface of the part has a negative charge. Most preferred are cathodic paint compositions such as epoxy and acrylic paints. Most preferred is a water-based cathodic epoxy. These materials are available in a variety of colors and specific formulations as will be appreciated by those skilled in the art. The general principles and details of cathodic electrodeposition are described more fully in various prior art references such as U.S. Pat. Nos. 5,203,975 and 4,959,277 and 4,308,121, the disclosures of which are incorporated herein by reference. It has been found that excellent coatings are obtained by agitating the small metal parts in the E-coat barrel prior to application of the current. This is achieved by partially rotating the barrel through an arc of about 120 degrees for about 1 to 2 minutes (approximately 2 to 4 times) immediately prior to electrically energizing the organic coating solution. This technique allows the parts to wet-out fully prior to bonding of the coating to the phosphated metal surfaces and eliminates air pockets which may otherwise interfere with the E-Coat process. Thus it will be understood that tank 36 includes female electrical wiper contacts 134 which are engaged to provide the electrical power necessary to oscillate barrel 56' while it is immersed in tank 36. Also, it will be appreciated by those skilled in the art that electrodeposition tank 36 includes the electrical connections associated with cathodic electrodeposition of coatings on metal parts, i.e. to impart a charge on the metal parts which attracts charged components of the organic coating material to the part surfaces. For cathodic electrodeposition, a charge may be applied for about 2 to about 10 minutes for this purpose, depending on total parts square footage.

Following application of a cathodic E-coat (and any necessary permeate rinses) the coated parts are discharged from the barrel onto a second vibratory tray 160. The parts are moved by the action of the vibrator to a conveyor belt 162 where they move through curing oven 40. It is important that the parts be separated on the conveyor belt as they pass through oven 40 to help minimize touch points during curing and this may be done either by adjusting the parameters of the vibratory feed mechanism or by hand. Most preferably, the heat source for the curing oven is a series of infra-red lamps which provide rapid cure of the cathodically coated parts. The oven may be non-circulatory since organic solvents are not used in the process.

Thus it is apparent that there has been provided in accordance with the invention an apparatus that fully satisfies the objects, aims and advantages set forth above. While the invention has been described in connection with specific embodiments thereof it is evident that many alternatives, modifications, and variations will be apparent to those skilled in the art in light of the foregoing description. Accordingly, it is intended to embrace all such alternatives, modifications and variations that fall within the spirit and broad scope of the appended claims.

What is claimed is:

1. A substantially automated electrodeposition line for coating parts, comprising:

a parts loading station, said parts loading station having a bin rotator and a vibratory feed tray;

first and second barrels and first and second barrel supporting carriages for supporting said barrels;

a series of tanks for holding metal coating liquids and adapted to receive said barrels therein, one of said tanks being an cathodic electrodeposition tank;

a parts transfer mechanism for transferring parts from said first barrel to said second barrel;

a parts unloading station for unloading parts from said second barrel;

a conveyor for receiving coated parts thereon;

a curing oven through which a portion of said conveyor extends; and at least one overhead programmed hoist for transferring said carriages and said barrels between said parts loading station, said tanks and said parts unloading station.

2. The invention recited in claim 1, wherein said bin rotator has a bin container having an opening to receive a bin containing said parts.

3. The invention recited in claim 1, wherein said first and second barrels are perforated.

4. The invention recited in claim 1, wherein said tanks have at least one electrical connector mounted thereon.

5. The invention recited in claim 4, wherein said first and second carriages each have at least one electrical connector mounted thereon and where said carriage electrical connectors have a configuration which mates with the configuration of said tank electrical connectors.

6. The invention recited in claim 5 wherein said carriage and said tank electrical connectors are cooperating blade and wiper assemblies.

7. The invention recited in claim 5, wherein said overhead programmed hoist further includes an electrical connector adapted to receive and electrically engage said electrical connectors of said carriages.

8. The invention recited in claim 1, wherein said programmed hoist has a lift bar and said carriages have lateral tabs for engaging said lift bar to support said carriages for movement by said overhead programmed hoist.

9. The invention recited in claim 1, wherein said parts transfer mechanism includes a hopper/feeder.

10. The invention recited in claim 1, wherein said parts transfer mechanism includes a shuttle.

11. The invention recited in claim 1, wherein said curing oven includes infra-red lamps.

12. The invention recited in claim 1, herein said curing oven is non-circulatory.

13. A barrel and carriage assembly, comprising:

a frame;

a barrel attached to said frame, said barrel being at least partially rotatable relative to said frame;

an electrical connector mounted on said frame;

a motor mounted on said frame and electrically connected to said electrical connector; and wherein said barrel is a free electrical contact.

14. The invention recited in claim 13, wherein said barrel includes side walls having and at least one of said side walls having an associated gear for rotating said barrel.

15. A barrel and carriage assembly, comprising:

a frame;

a barrel attached to said frame, said barrel being at least partially rotatable relative to said frame;

an electrical connector mounted on said frame;

a motor mounted on said frame and electrically connected to said electrical connector; and wherein said barrel has a plurality of spacer cones mounted in its interior.

16. A barrel and carriage assembly, comprising:

a frame;

a barrel attached to said frame, said barrel being at least partially rotatable relative to said frame;

an electrical connector mounted on said frame;

a motor mounted on said frame and electrically connected to said electrical connector; and wherein said frame has a plurality of tabs for engaging corresponding structures on an overhead crane.

17. A substantially automated electrodeposition line for coating parts, comprising:

a parts loading station, said parts loading station having a bin rotator and a vibratory feed tray;

first and second barrels and first and second barrel supporting carriages for supporting said barrels, said first and second carriages each having a free electrical contact mounted thereon, and each barrel being mounted on said carriage for at least partial rotary movement with respect to said carriages;

a series of tanks for holding metal coating liquids and adapted to receive said barrels therein, one of said tanks being an cathodic electrodeposition tank and at least one of said tanks having an electrical connector adapted to engage said free electrical contacts of said carriages;

a parts transfer mechanism for transferring parts from said first barrel to said second barrel;

a parts unloading station for unloading parts from said second barrel;

a conveyor for receiving coated parts thereon;

a curing oven through which a portion of said conveyor extends; and at least one overhead programmed hoist for transferring said carriages and said barrels between said parts loading station, said tanks and said parts unloading station, said overhead programmed hoist having at least one electrical connector adapted to engage said free electrical contacts of said carriages.

* * * * *